US007575527B2

(12) United States Patent
Davis et al.

(10) Patent No.: US 7,575,527 B2
(45) **Date of Patent: *Aug. 18, 2009**

(54) COMPOSITE BAT HAVING A SINGLE, HOLLOW PRIMARY TUBE STRUCTURE

(75) Inventors: Stephen J. Davis, Newtown, PA (US); Roberto Gazzara, Mestre (IT); Mauro Pinaffo, Camposampiero (IT); Michele Pozzobon, Fossalunga di Vedelago (IT); Mauro Pezzato, Treviso (IT)

(73) Assignee: Prince Sports, Inc., Bordentown, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/524,990

(22) Filed: Sep. 20, 2006

(65) Prior Publication Data

US 2008/0070725 A1 Mar. 20, 2008

(51) Int. Cl.
*A63B 59/06* (2006.01)

(52) U.S. Cl. ..... 473/567; 473/566; 473/317

(58) Field of Classification Search ..... 473/457, 473/519, 520, 560–568
See application file for complete search history.

(56) References Cited

U.S. PATENT DOCUMENTS

| | | | | |
|---|---|---|---|---|
| 59,313 | A * | 10/1866 | Hill | 473/564 |
| 729,639 | A | 6/1903 | McCoy | |
| 1,025,478 | A * | 5/1912 | Murphy | 473/568 |
| 1,530,427 | A * | 3/1925 | Simon | 473/564 |
| 2,033,722 | A | 3/1936 | MacFarland | |
| 2,321,773 | A | 6/1943 | Rumelin | |
| 3,377,066 | A * | 4/1968 | Trowbridge | 473/564 |
| 3,392,976 | A * | 7/1968 | Hayes | 473/564 |
| 4,086,115 | A | 4/1978 | Sweet | |
| 4,124,208 | A | 11/1978 | Burns | |
| 4,264,389 | A | 4/1981 | Staub | |
| 4,358,113 | A | 11/1982 | McKinnon | |
| 4,600,193 | A | 7/1986 | Merritt | |
| 4,795,153 | A | 1/1989 | Thomas | |
| 4,931,427 | A | 6/1990 | Yeh | |
| 5,082,279 | A | 1/1992 | Hull | |
| 5,097,870 | A | 3/1992 | Williams | |
| 5,153,798 | A | 10/1992 | Ruigrok | |
| 5,179,255 | A * | 1/1993 | Yeh | 181/182 |
| 5,249,846 | A | 10/1993 | Martin | |
| 5,285,008 | A | 2/1994 | Sas-Jaworsky | |

(Continued)

FOREIGN PATENT DOCUMENTS

| | | |
|---|---|---|
| CA | 2154370 | 3/1997 |

(Continued)

OTHER PUBLICATIONS

U.S. Appl. No. 11/509,999, filed on Aug. 26, 2006, Stephen J. Davis.

(Continued)

*Primary Examiner*—Mark S Graham
(74) *Attorney, Agent, or Firm*—Abelman Frayne & Schwab

(57) ABSTRACT

A bat preferably is formed of a single, hollow tube of composite material, wherein tubular "ports" extend through the hollow tube. The ends of the ports are bonded to the walls of the hollow tube. The ports improve the stiffness, strength, aerodynamics and comfort of the bat.

29 Claims, 8 Drawing Sheets

U.S. PATENT DOCUMENTS

| | | | | |
|---|---|---|---|---|
| 5,297,791 | A | 3/1994 | Negishi | |
| 5,301,940 | A * | 4/1994 | Seki et al. | 473/567 |
| 5,303,916 | A | 4/1994 | Rodgers | |
| 5,419,553 | A | 5/1995 | Rodgers | |
| 5,614,305 | A | 3/1997 | Paine | |
| 5,636,836 | A | 6/1997 | Carroll | |
| 5,746,955 | A | 5/1998 | Calapp | |
| 5,766,104 | A * | 6/1998 | Albarelli, Jr. | 473/567 |
| 5,865,696 | A | 2/1999 | Calapp | |
| 5,879,250 | A | 3/1999 | Tahtinen | |
| 5,975,645 | A | 11/1999 | Sargent | |
| 6,042,493 | A * | 3/2000 | Chauvin et al. | 473/566 |
| 6,086,161 | A | 7/2000 | Luttgeharm | |
| 6,113,508 | A | 9/2000 | Locarno | |
| 6,129,962 | A | 10/2000 | Quigley | |
| 6,241,633 | B1 | 6/2001 | Conroy | |
| 6,383,101 | B2 | 5/2002 | Eggiman et al. | |
| 6,485,382 | B1 * | 11/2002 | Chen | 473/566 |
| 6,663,517 | B2 | 12/2003 | Buiatti et al. | |
| 6,723,012 | B1 | 4/2004 | Sutherland | |
| 6,761,653 | B1 | 7/2004 | Higginbotham et al. | |
| 6,764,419 | B1 | 7/2004 | Giannetti et al. | |
| 6,776,735 | B1 | 8/2004 | Belanger et al. | |
| 6,800,239 | B2 | 10/2004 | Davis | |
| 6,808,464 | B1 | 10/2004 | Nguyen | |
| 6,866,598 | B2 | 3/2005 | Giannetti et al. | |
| 6,872,156 | B2 | 3/2005 | Ogawa et al. | |
| 7,014,580 | B2 | 3/2006 | Forsythe | |
| 7,207,907 | B2 * | 4/2007 | Guenther et al. | 473/566 |
| 7,309,299 | B2 | 12/2007 | Pezzato | |
| 7,396,303 | B2 | 7/2008 | Gazzara | |
| 2003/0104152 | A1 | 6/2003 | Sommer | |
| 2003/0162613 | A1 | 8/2003 | Davis | |
| 2004/0048683 | A1 | 3/2004 | Burrows | |
| 2004/0198538 | A1 | 10/2004 | Goldsmith | |
| 2004/0198539 | A1 | 10/2004 | Sutherland | |
| 2005/0062337 | A1 | 3/2005 | Meggiolan | |
| 2005/0153798 | A1 * | 7/2005 | Rigoli | 473/513 |
| 2005/0153799 | A1 | 7/2005 | Rigoli | |
| 2005/0164814 | A1 | 7/2005 | Tucker | |
| 2005/0221924 | A1 | 10/2005 | Sutherland | |
| 2006/0122013 | A1 * | 6/2006 | Dodge et al. | 473/516 |
| 2006/0247077 | A1 | 11/2006 | Deetz | |
| 2007/0123376 | A1 | 5/2007 | Gazzara | |
| 2007/0135245 | A1 | 6/2007 | Gazzara | |
| 2007/0200422 | A1 | 8/2007 | Davis | |
| 2007/0222178 | A1 | 9/2007 | Davis | |
| 2007/0238560 | A1 | 10/2007 | Gazzara | |
| 2007/0293344 | A1 | 12/2007 | Davis | |

FOREIGN PATENT DOCUMENTS

| | | |
|---|---|---|
| CA | 2231908 | 9/1999 |
| DE | 4415509 | 11/1995 |
| EP | 1859838 | 11/2007 |
| EP | 1859839 | 11/2007 |
| JP | 53038431 | 4/1978 |
| JP | 02255164 | 10/1990 |
| JP | 05015624 | 1/1993 |
| JP | 98117968 | 5/1997 |
| JP | 11276652 | 10/1999 |
| JP | 2000042155 | 2/2000 |
| WO | WO 84/03447 | 9/1984 |
| WO | WO 94/26361 | 11/1994 |
| WO | WO 00/09219 | 2/2000 |
| WO | WO 01/26752 | 4/2001 |
| WO | WO 03/076176 | 9/2003 |
| WO | WO 2004/075996 | 9/2004 |

OTHER PUBLICATIONS

US 7,223,188, 05/2007, Davis (withdrawn)

* cited by examiner

COMPOSITE BAT HAVING A SINGLE, HOLLOW PRIMARY TUBE STRUCTURE

BACKGROUND OF THE INVENTION

The present invention relates to a composite structure for a bat.

The performance of a baseball or softball bat is determined by a number of factors such as weight, swing weight, ball rebound velocity, strength, and aerodynamics. The traditional metal or composite material bat is a single tubular structure with a hitting portion, a gripping portion, and a tapered portion connecting the two. The wall thickness can vary along its length to provide specific performance needs. The bat may be made from a number of materials such as aluminum, steel, titanium, and light weight composite materials.

The weight of a bat is a critical feature in determining performance. The lighter the bat weight, the easier it is to swing the bat resulting in higher swing speeds. Therefore, the lightest materials and designs are used to achieve these performance goals. The most popular high performance material for modern bat design is carbon fiber reinforced epoxy resin (CFE) because it has the highest strength and stiffness-to-weight ratio of any realistically affordable material. As a result, CFE can produce a very light weight bat with excellent strength as well as providing a variety of stiffnesses.

Another very important characteristic is how the ball rebounds off the face of the bat. A desired characteristic is to have the face of the bat deform and return during ball contact to increase the rebound velocity or coefficient of restitution (COR). This can be accomplished by producing the bat as a hollow structure, with the walls of the bat produced using a light weight metal or fiber reinforced composite material. However, care should be taken not to make the walls too thin and weak, because considerable hoop stress exists when the bat contacts the ball.

Another desirable feature in a bat is comfort. Striking the ball off the center region or "sweet spot" of the bat can be a painful experience due to the resulting torque (shock) and vibrations transmitted to the hands. All types of shock and vibration are magnified with a bat of a lighter weight, which doesn't have the sufficient mass or inertia to absorb the shock or damp the vibrations.

Another desirable feature in a bat is aerodynamics. However, aerodynamics have not been seriously considered in the past because most bats are restricted by their external geometry and bat diameter which determines aerodynamic drag.

The evolution of the modern bat over the past twenty years has focused on light weight, improving ball rebound velocity, comfort, improving strength, and aerodynamics. However, there has not been a bat that has all of the mentioned performance benefits.

An example of producing a bat out of light weight composite materials is U.S. Pat. No. 4,931,247 to Yeh who discloses a process of rolling up sheets of fibers impregnated with resin and placing in a mold and internally inflating using a bladder. This created a light weight product which was easier to swing.

A design to increase the Coefficient of Restitution (COR) of a bat is shown by U.S. Pat. No. 6,872,156 to Ogawa, et. al., who describes a bat with an exterior elastic sleeve in the hitting portion of the bat to improve ball rebound velocity. Other examples are U.S. Pat. Nos. 6,764,419 and 6,866,598 to Giannetti et. al., and U.S. patent No. to Buiatti, et. al., who describe a bat with a thin cylindrical outer wall, an internal cylindrical inner wall with material in between to improve the ball rebound velocity and to improve strength.

U.S. Pat. No. 6,808,464 to Nguyen discloses an improvement to the comfort of a composite bat by using elastomeric caps at the end of outer walls and internal walls to create a wood like feel and damp vibrations.

U.S. Pat. No. 6,383,101 to Eggiman, et. al., describes an insert or sleeve of a fiber reinforced composite material with fibers aligned circumferentially to obtain improved strength. Other examples of using composite materials to improve strength are disclosed by U.S. Pat. No. 6,723,012 to Sutherland who uses a three-dimensional fiber reinforcement architecture to improve durability, and U.S. Pat. No. 6,776,735 to Belanger, et. al., who use continuous fibers embedded in a resin to achieve superior strength over the traditional wood bats. Also, U.S. Pat. No. 6,761,653 to Higginbotham, et. al. combines a metal bat with an exterior fiber reinforced composite shell to improve strength.

There exists a continuing need for an improved bat system. In this regard, the present invention substantially fulfills this need.

SUMMARY OF THE INVENTION

The present invention is for a structure for a bat where a portion of the structure is formed of a single, hollow tube having at least one, and preferably a series, of "ports" that extend through the hollow tube. The ports provide specific performance advantages. Each port has a peripheral wall that extends between opposed holes in the hollow tube. The opposite ends of each port are bonded to the tube. The wall forming the port, which extends between opposite sides of the tube, preferably is shaped to act as opposing arches which provide additional strength, stiffness, comfort, and aerodynamic benefits.

The bat system according to the present invention substantially departs from the conventional concepts and designs of the prior art and in doing so provides an apparatus primarily developed for the purpose of improved strength, stiffness, comfort, aerodynamics, and appearance.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The present invention provides a new and improved bat system which may be easily and efficiently manufactured.

The present invention provides a new and improved bat system which is of durable and reliable construction.

The present invention provides a new and improved bat system which may be manufactured at a low cost with regard to both materials and labor The present invention further provides a bat system that can provide specific stiffness zones at various orientations and locations along the length of the bat.

The present invention provides an improved bat system that has superior strength and fatigue resistance.

The present invention provides an improved bat system that has improved shock absorption and vibration damping characteristics.

The present invention provides an improved bat system that has improved aerodynamics.

The present invention provides an improved bat system that has a unique look and improved aesthetics.

Lastly, the present invention provides a new and improved bat system made with a single tube design, where tubular "ports" extend through opposed holes in the tube to form walled apertures that extend through the bat. The ports preferably are shaped as double opposing arches to provide a means of adjusting the stiffness, resiliency, strength, comfort, and aerodynamics of the implement.

For a better understanding of the invention and its advantages, reference should be made to the accompanying drawings and descriptive matter in which there are illustrated preferred embodiments of the invention.

BRIEF DESCRIPTION OF THE DRAWINGS

The same reference numerals refer to the same parts throughout the various Figures.

DETAILED DESCRIPTION OF THE INVENTION

As described below, a portion of the bat is formed of a single tube where apertures, i.e., "ports," are formed through opposed holes in the tube.

The resulting structure is found to have superior performance characteristics for several reasons. The ports are in the shape of double opposing arches which allow the structure to deflect which deforms the ports, and return with more resiliency. The ports also allow greater bending flexibility than would traditionally be achieved in a single tube design. The structure can also improve comfort by absorbing shock and damping vibrations due to the deformation of the ports. Finally, the ports can improve aerodynamics by allowing air to pass through the bat to reduce the wind resistance and improve maneuverability.

Figure 1:
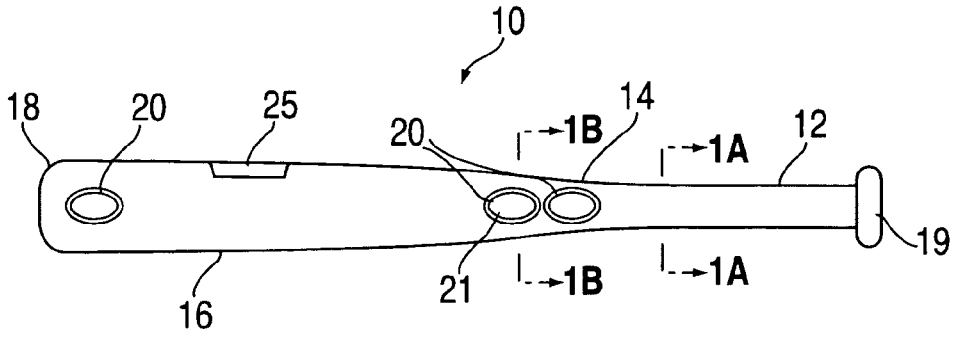
FIG. 1 is a side view of a bat constructed in accordance with an embodiment of the present invention.

FIG. 1 illustrates a bat, which is referred to generally by the reference numeral 10. The bat 10 is comprised of a handle portion 12, a tapered portion 14, a hitting portion 16, a tip end 18, and a butt end 19.

FIG. 1 shows one preferred embodiment wherein the bat 10 contains tubular "ports" 20, which define through openings oriented in line and with axes parallel to the direction of swing. Ports oriented in this manner provide improved aerodynamics by reducing the exposed frontal area of the bat to the wind as the bat is swung. The ports 20 can be located anywhere along the length of the bat. FIG. 1 shows ports only in the tapered region 14 and the tip end 18, leaving the hitting portion 16 void of ports. However, if desired, ports could be located in the hitting portion 16 and the handle portion 12.

The tube is preferably made from a long fiber reinforced prepreg type material. Traditional lightweight composite structures have been made by preparing an intermediate material known as a prepreg which will be used to mold the final structure.

A prepreg is formed by embedding the fibers, such as carbon, glass, and others, in resin. This is typically done using a prepreg machine, which applies the non-cured resin over the fibers so they are all wetted out. The resin is at an "B Stage" meaning that only heat and pressure are required to complete the cross linking and harden and cure the resin. Thermoset resins like epoxy are popular because they are available in liquid form at room temperature, which facilitates the embedding process.

A thermoset is created by a chemical reaction of two components, forming a material in a nonreversible process. Usually, the two components are available in liquid form, and after mixing together, will remain a liquid for a period of time before the crosslinking process begins. It is during this "B Stage" that the prepreg process happens, where the resin coats the fibers. Common thermoset materials are epoxy, polyester, vinyl, phenolic, polyimide, and others.

The prepreg sheets are cut and stacked according to a specific sequence, paying attention to the fiber orientation of each ply.

Each prepreg layer comprises an epoxy resin combined with unidirectional parallel fibers from the class of fibers including but not limited to carbon fibers, glass fibers, aramid fibers, and boron fibers.

The prepreg is cut into strips at various angles and laid up on a table. The strips are then stacked in an alternating fashion such that the fibers of each layer are different to the adjacent layers. For example, one layer may be +30 degrees, the next layer −30 degrees. If more bending stiffness is desired, a lower angle such as 20 degrees can be used. If more torsional stiffness is desired, a higher angle such as 45 degrees can be used. In addition, 0 degrees can be used for maximum bending stiffness, and 90 degrees can be used to resist impact forces and to maintain the geometric structural shape of the tube.

This layup, which comprises various strips of prepreg material, is then rolled up into a tube. This tube may form the entire structure of the bat, or a portion of the bat structure.

Figure 4:
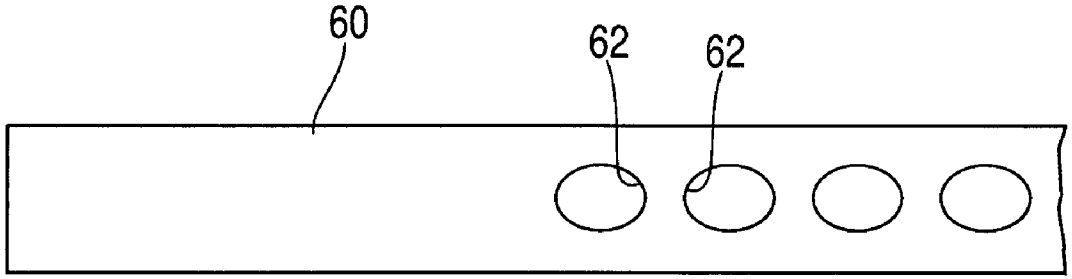
FIG. 4 is a front view of a portion of a prepreg tube during formation of the component tube.

Referring to FIG. 4, according to the preferred embodiment of the invention, a suitable prepreg tube 60 is formed in the manner just described, with the various composite plies oriented at the desired angles. Next, a plurality of openings 62 are formed through opposing walls the tube, perpendicular to the axis of the tube. The openings 62 may be stamped through the walls. More preferably, a tool is used to separate the carbon fibers from one another, without cutting the fibers, to form the openings 62. The openings, at this stage, need not have the final desired shape.

Figure 5:
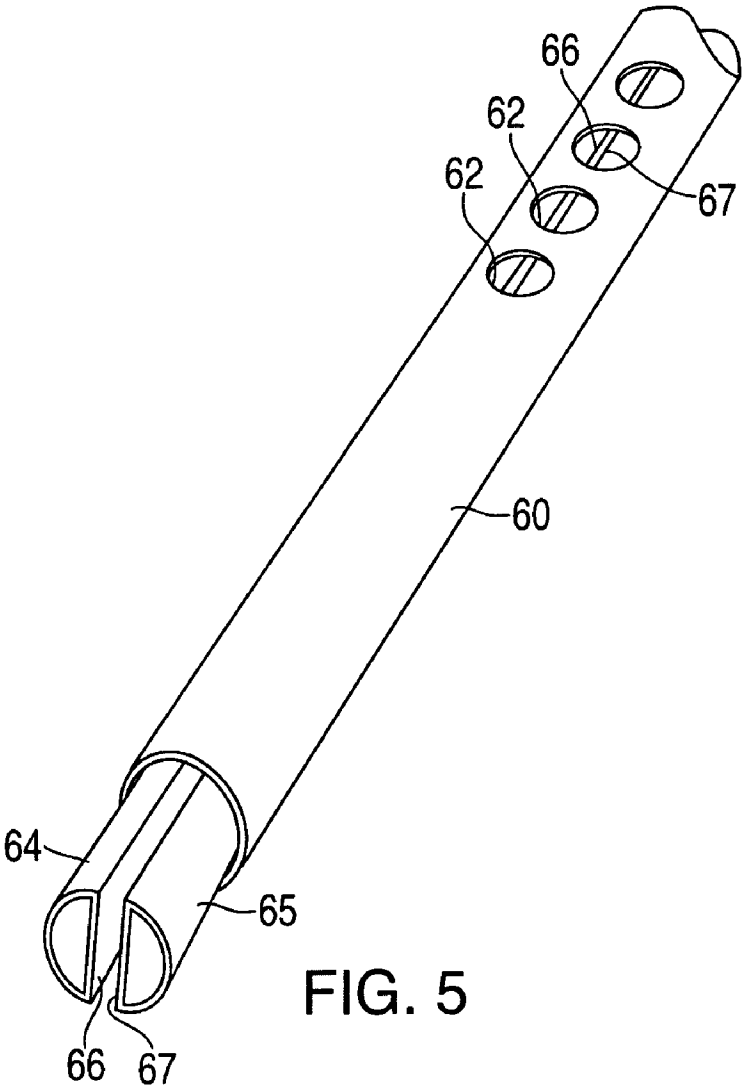
FIG. 5 is an isometric view of the prepreg tube of FIG. 4 during a subsequent step in forming the component tube.

Referring to FIG. 5, next a pair of inflatable thin walled polymeric bladders 64, 65, preferably made of nylon, are inserted through the tube 60 such that their facing walls 66, 67 are aligned with the openings 62.

Figure 6:
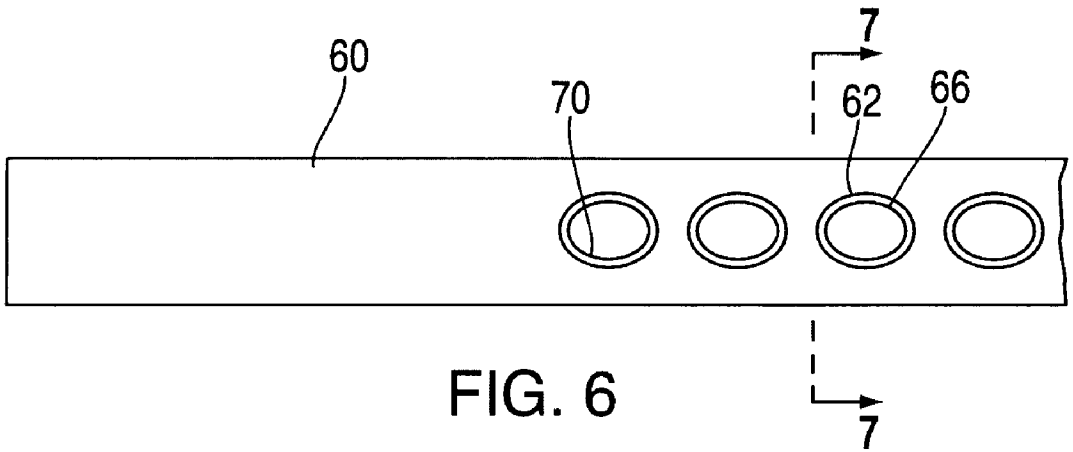
FIG. 6 is a front view of the prepreg tube of FIG. 5 during a subsequent step in forming the component tube.
Figure 7:
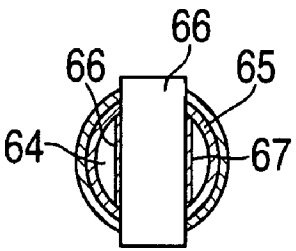
FIG. 7 is a sectional view of the prepreg tube of FIG. 6, taken in the direction of arrows 7-7 of FIG. 6.

Referring to FIGS. 6-7, after the bladders 64, 65 have been inserted, a hollow, tubular plug 66 is inserted through each of the holes 62, between the facing walls 66, 67 of the bladders, i.e., separating the bladders. The ends of the plugs 66 preferably extend beyond the outer surfaces of the prepreg tube 60, as shown in FIG. 7. The plugs are preferably tubes of prepreg material. However, if desired the plugs may be made of other materials such as metal or plastic.

Figure 8:
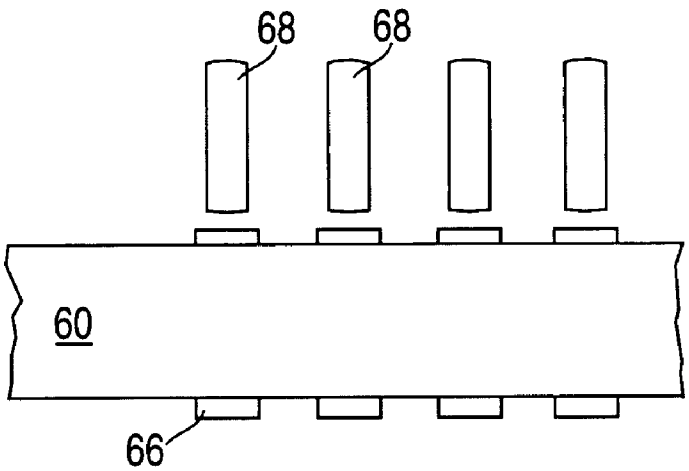
FIG. 8 is a side view of the prepreg tube of FIG. 6 during a subsequent step in the formation of the component tube.

Finally, as shown in FIG. 8, if the plugs 66 are formed of prepreg material, a mold pin 68 is inserted through each plug 66 to form the internal geometry of the ports. This may occur prior to mold packing, or during the mold packing process.

The tube is then packed into a mold which forms the shape of the bat portion. Air fittings are applied to the interior of the bladders 64 and 65 at the end of the tube 60. The bladders may be closed on the other end of the tube, or connected to other air fittings, or are connected in the shape of a hairpin to form one continuous "U" shaped bladder inside the tube 60. The mold is then closed over the tube 60 and placed in a heated platen press. For epoxy resins, the temperature is typically around 350 degrees F. While the mold is being heated, the tube 60 is internally pressurized, which compresses the prepreg material and forces the tube 60 to assume the shape of the mold. At the same time, the heat cures the epoxy resin. The bladders also compress the peripheral walls of the plugs 66, so that the inwardly facing surface 70 of each plug 66 conforms to the shape of the mold pin 68 (which is preferably oval). At the same time, the heat and pressure cause the ends of the plug walls to bond to the wall of the prepreg tube 60.

Once cured, the mold is opened in the reverse sequence of packing. The pins 68 are typically removed first, followed by the top portion of the mold. Particular attention is needed if removing the top portion with the pins 68 intact to ensure this is done in a linear fashion. Once the pins 68 have been removed from the component tube, the component can be removed from the bottom portion of the mold.

Figure 10:
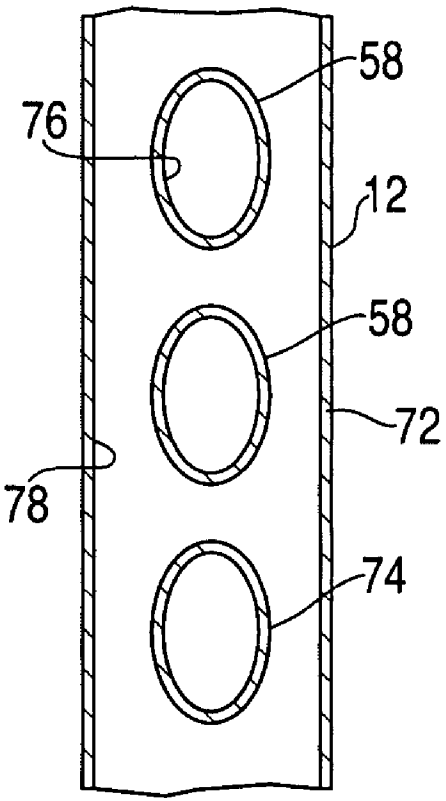
FIG. 10 is a sectional view of a portion of the component tube, taken in the direction of arrows 10-10 in FIG. 9
Figure 9:
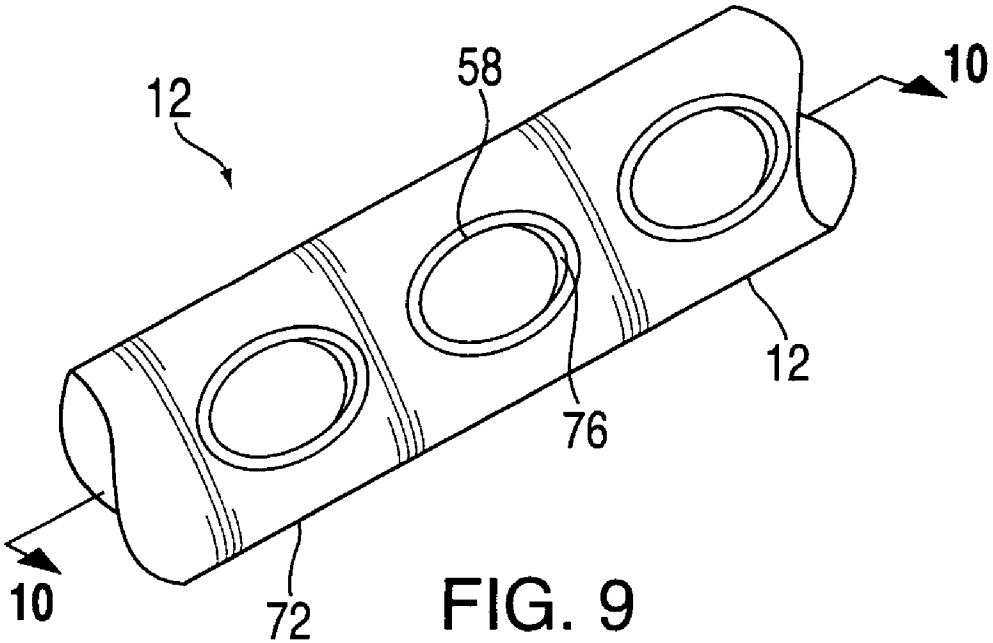
FIG. 9 is an enlarged, isometric view of a portion of the component tube after molding.

As shown in FIGS. 9-10, after molding, the tube 12 is formed of a single, hollow component tube 72, with a plurality of ports 58 extending through the tube 72. The ends of the port walls 74 are bonded to the portions of the tube 72 surrounding the ports 58, and the inwardly facing surfaces 76 of the ports 58 extend completely through the component tube 72.

The composite material used is preferably carbon fiber reinforced epoxy because the objective is to provide reinforcement at the lightest possible weight. Other fibers may be used such as fiberglass, aramid, boron and others. Other thermoset resins may be used such as polyester and vinyl ester. Thermoplastic resins may also be used such as nylon, ABS, PBT and others.

Figure 1A:
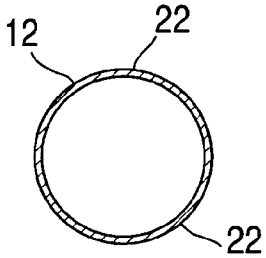
FIG. 1A is a cross sectional view of the bat taken along lines 1A-1A of FIG. 1.

With reference to FIG. 1A, this cross sectional view along the lines 1A-1A of FIG. 1 shows the single tube with a continuous wall 22 without a port.

Figure 1C:
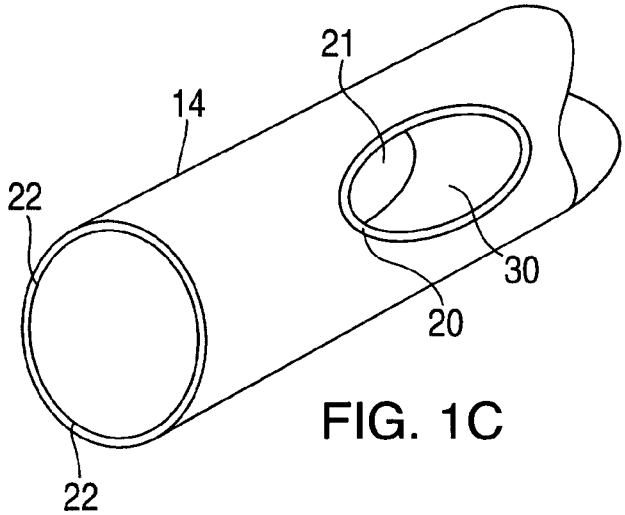
FIG. 1C is an isometric cut away view of a portion of the bat shown in FIG. 1.
Figure 1B:
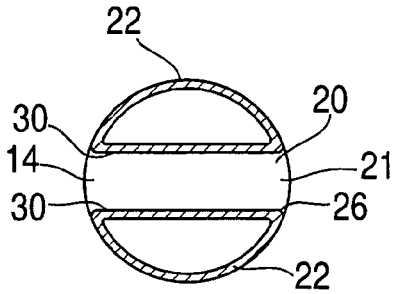
FIG. 1B is a cross sectional view of the bat taken along lines 1B-1B of FIG. 1.

FIG. 1B shows a cross sectional view along the lines 1B-1B of FIG. 1 through port 20 where the internal wall 30 connects to the walls 22 of taper portion 14 It is advisable to have a radius (i.e., rounded edges 26) leading into the port so to reduce the stress concentration and to facilitate the molding process.

The batter may orient the bat so that the desired port(s) face the direction of swing. Alternately, the bat may include a label 25 on the upper surface, or some other type of indicator, so that the user knows how to orient the bat when it is gripped.

FIG. 1C is an isometric view of the taper portion 14 of FIG. 1 isolated to one port. The taper portion 14 is comprised of a single wall tube 22. In this example, the axis of the port 20 is perpendicular to the axis of the taper portion 14 and parallel to the direction of travel. An internal wall 30 is formed to connect to the opposite sides 22 of taper portion 14.

Figure 2:
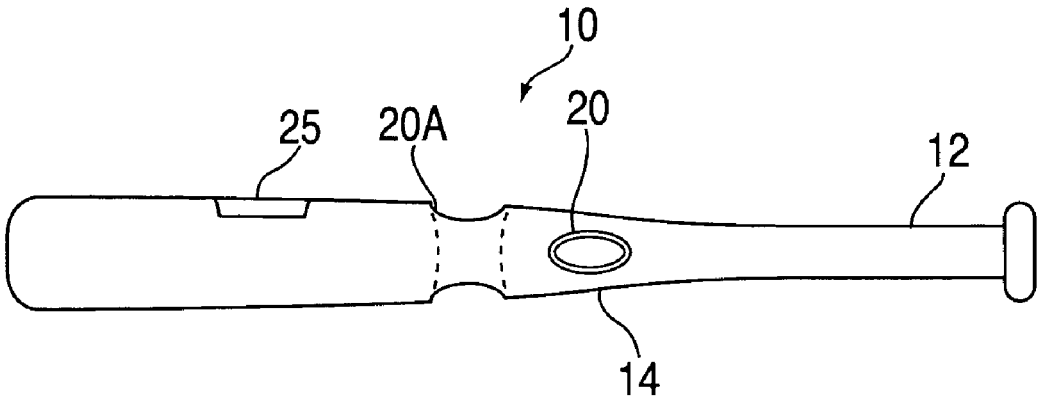
FIG. 2 is a side view of another bat constructed in accordance with an embodiment of the present invention.

An alternative embodiment is to orient the ports so the axes are perpendicular to the direction of travel of the bat. As shown in FIG. 2, the port 20*a* oriented in this manner provides the means to achieve more flexibility of the bat because the double arch structure can provide more bending in this direction. This can provide more comfort for the batter. In this embodiment the bat 10 is designed using a multiple bladder construction which allows for port 20 and port 20*a* to be oriented at different angles. In this particular example, the port 20 near the handle portion 12 provides improved aerodynamics, and the port 20*a* near the hitting portion 16 provides improved flexibility and shock absorption.

Figure 2A:
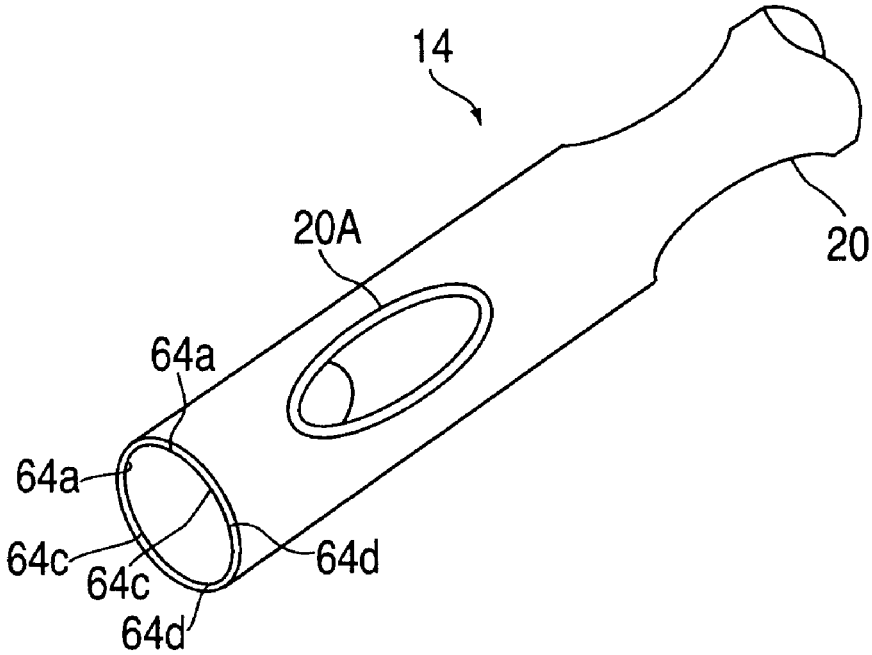
FIG. 2A is an isometric cutaway view of a portion of the bat shown in FIG. 2.

FIG. 2A is an isometric view of a cutaway portion of the taper portion 14 of FIG. 2. In this example, two ports are adjacent to each other but at different angles. Four bladder tubes 64*a,b,c,d* are used to form the structure. The bladder tubes 64*a,d* are separated from bladder tubes 64 *b,c* to form port 20, and bladder tubes 64 *a,b* are separated from bladder tubes 64*c,d* to form port 20A. It is also possible to mold the taper portion 14 using two bladder tubes, by changing the position of the tubes as the orientation of the ports change. Each port is molded as discussed previously, by inserting prepreg plugs through opposing holes in the prepreg tube, and between the bladder tubes, and wrapping the prepreg plugs to attach to the walls of the prepreg tube. Pins are inserted to form the internal walls of the ports.

Figure 3:
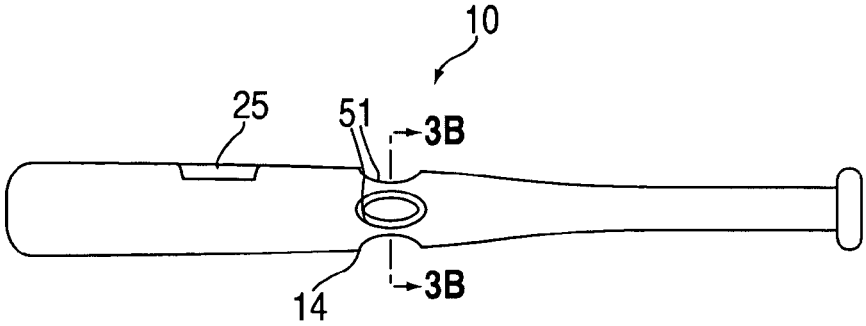
FIG. 3 shows an alternative example of how multiple ports could be formed in a single location.

FIG. 3 is a side view of bat 10 with multiple ports located in the same location. This can also be accomplished with a four bladder manufacturing method.

Figure 3A:
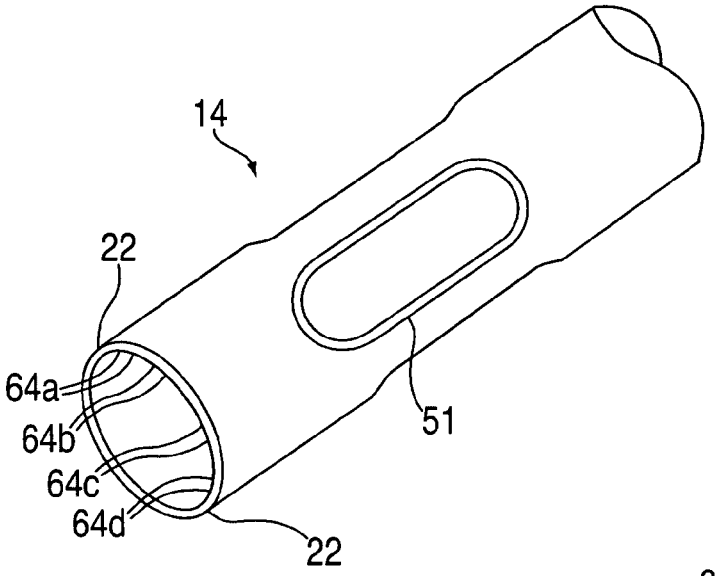
FIG. 3A is an isometric cutaway view of a section of the bat of FIG. 3.

FIG. 3A is an isometric cutaway view of a taper portion 14 with four ports located in the same location. This results in an port 51 that is open on four sides.

Figure 3B:
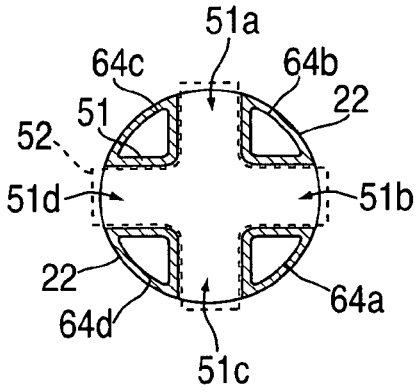
FIG. 3B is a cross sectional view taken along the lines 3B-3B of FIG. 3.

In this example, four bladders 64*a,b,c,d* are used. An internal, cross-shaped pin 52 (shown in broken lines), whose four arms are preferably round or oval in cross-section, is used to form a double port 51 having four openings 51*a,b,c,d* as shown in FIG. 3B. The process to form the ports is similar to previously mentioned processes. Prior to molding, prepreg material is wrapped around the cross-shaped pin and positioned within the prepreg tube so that the four ends of the pin extend through four openings in the prepreg tube. In this position, the four ends of the prepreg material wrapped around the pin are in contact with the walls 22 of taper portion 14 and bond thereto during molding. Each bladder tube is positioned in each quadrant formed between the legs of the pin as shown in FIG. 3B. After molding, the cross-shaped pin 52 is removed.

The cross shaped pin 52 can be formed of multiple piece design where the legs of the pin can be disassembled for removal purposes. For example, the pin legs can fit together with an internal core when removed allows for the remainder of the legs to be removed. Another option is a dissolvable material, which is a solid for forming the port, after which can be dissolved with hot water.

There can be any number of ports depending on the number of internal bladder tubes used and the number of cutaway portions as well as pins and prepreg plugs.

Figure 11:
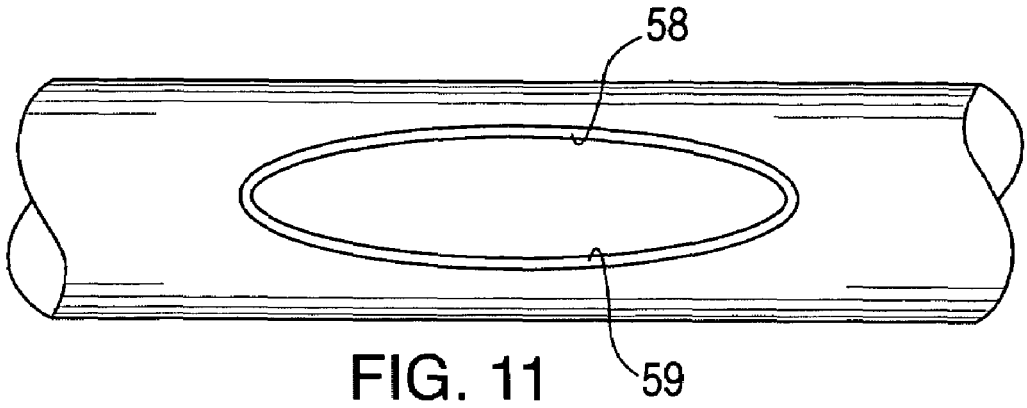
FIG. 11 shows various shapes of ports.
Figure 11A:
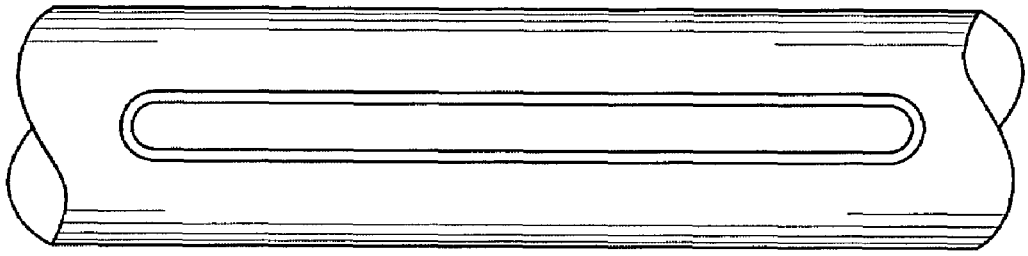
Figure 11B:
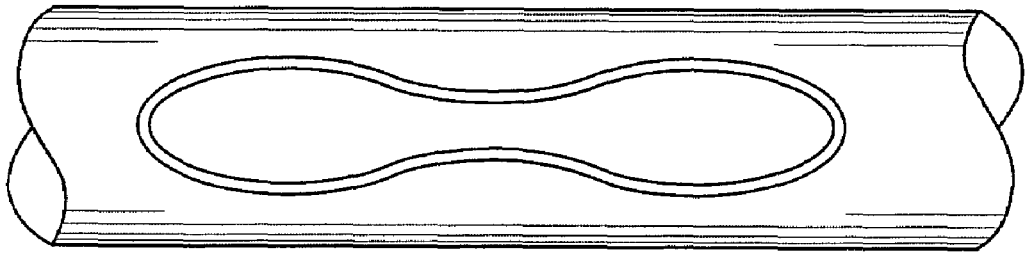
Figure 11C:
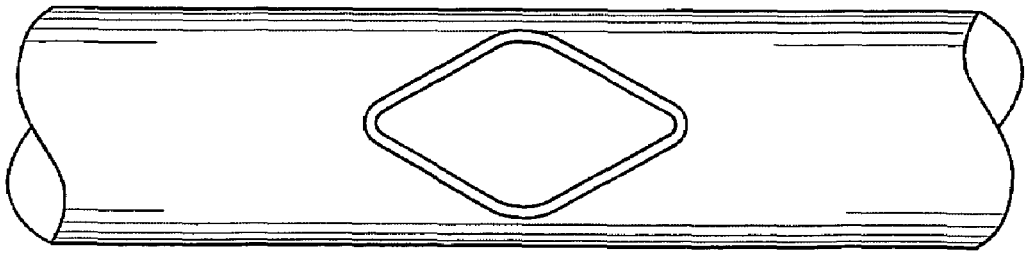

FIG. 11 illustrates some examples of the variety of shapes possible to be used for the ports. Depending on the performance required of the structure at a particular location, more decorative port shapes can be used.

In all orientations, the quantity, size, and spacing of the ports can vary according to the performance desired. In addition, ports can be located in the handle portion and fitted with elastomeric inserts to provide additional cushioning, or wrapped with a perforated grip to provide air circulation to aid in keeping the grip dry.

An alternative embodiment is to combine the composite portion with a metal portion. In this example, the metal tube can be the hitting portion of the bat and fused or co-molded with the ported composite in the tapered portion to produce a lower cost alternative to a 100% carbon composite construction. This can produce a less expensive structure that can still achieve the performance and aesthetic requirements of the product.

Figure 12:
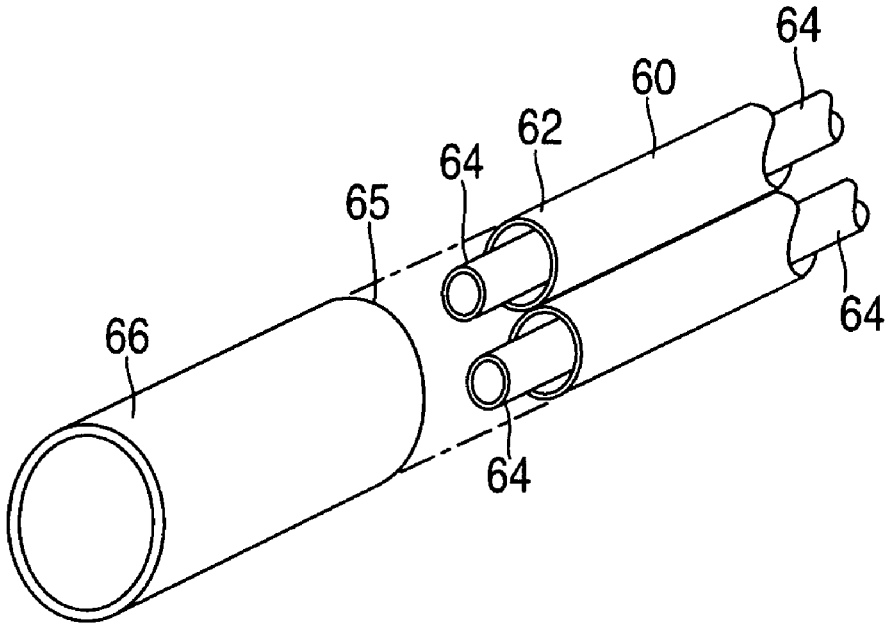
FIGS. 12-13 are perspective views illustrating a process for forming a frame member of two different materials.
Figure 13:
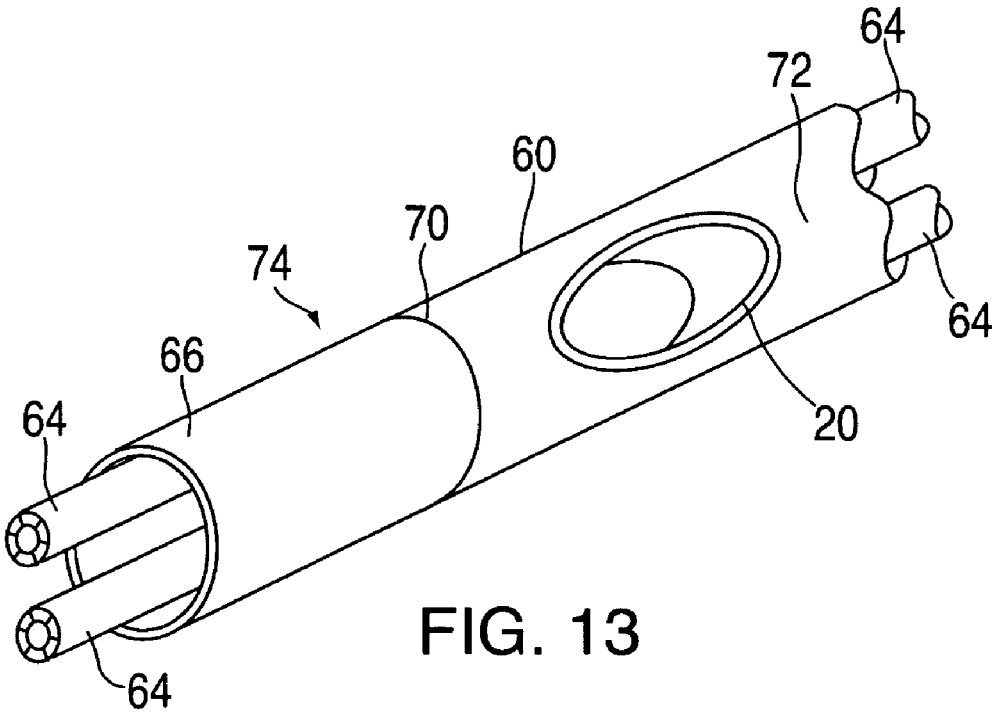

Referring to FIGS. 12-13, in order to make this construction, the forward end 62 of a prepreg tube 60, having a pair of inflatable bladders 64, are inserted into one end 65 of a metal tube 66. The unit is placed inside a mold having the same shape of the metal tube 66, at least at the juncture 70 of the prepreg tube 60 and the metal tube 66. Holes are formed in prepreg tube 60 (not shown) and a pin or mold member (not shown) is placed between the bladders 64 where a port 20 is to be formed. Prepreg reinforcements are wrapped around the pin and attached to the walls of prepreg tube 60 (not shown). The mold is then closed and heated, as the bladders 64 are inflated, so that the prepreg tube 60 assumes the shape of the mold. After the prepreg tubes have cured, the frame member 74 is removed from the mold, and the mold member or pin is removed, leaving the port 20. In this embodiment, the seam 70 between the graphite portion 60 and the metal member 66 should be flush, giving frame member 74 the appearance of a continuous tube.

In addition, the ports may be formed using a cylindrical metal plug which can be welded or bonded to the metal tube. This can produce a less expensive structure that can still achieve the performance and aesthetic requirements of the product The ported tube construction can also provide more comfort to the batter. As mentioned previously, the stiffness of the tubular part can be optimized to provide greater flexibility if desired. For example the ports oriented at 90 degrees to the direction of swing to provide a more flexible zone for enhanced batter comfort.

Another advantage of the invention is the absorption of the shock wave traveling up axis of the bat. This can occur when striking the ball outside the sweet spot of the bat. Having ports along the length of the shaft which can deform and absorb this force will be an advantage.

Another advantage of the invention is vibration damping. Vibrations are damped more effectively with the opposing double arch construction. This is because the movement and displacement of the arches absorbs energy which damps vibrations. As the tubular parts deflect, the shape of the ports can change, allowing a relative movement between the portions of the tube either side of the port. This movement absorbs energy which damps vibrations.

The aerodynamic benefit provided by the ports is determined by the size of the ports relative to the diameter of the bat. In comparing the frontal area of a shaft section which is subjected to an aerodynamic force, it is possible to achieve a reduced frontal area of up to 25%. This is a significant achievement for a bat, especially considering that stiffness and strength are not compromised, but in fact improved.

Finally, there is a very distinguished appearance to a bat made according to the invention. The ports are very visible, and give the tubular part a very light weight and aerodynamic look, which is important in bat marketing. The ports can also be painted a different color, to further enhance the signature look of the technology.

There are unlimited combinations of options when considering a double opposing arch structure. The ports can vary by shape, size, location, orientation and quantity. The ports can be used to enhance stiffness, resilience, strength, comfort, aerodynamics, and aesthetics. For example in a low stress region, the size of the port can be very large in order to maximize aerodynamics and appearance. If more deflection or resilience is desired, the shape of the aperture can be very long and narrow to allow more flexibility. The ports may also use designer shapes to give the product a stronger appeal.

If more vibration damping is desired, the ports can be oriented and shaped at a particular angle, and constructed using fibers such as aramid or liquid crystal polymer. As the port deforms as a result of shaft deflection, its return to shape can be controlled with these viscoelastic materials which will increase vibration damping. Another way to increase vibration damping is to insert an elastomeric material inside the port.

Another advantage of the invention could be to facilitate the attachment to the butt cap. Having a port at the butt end of the handle provides a mechanical means of attachment of the butt cap to the handle. A similar advantage exists at the tip, if a special designed cap were to attach to the hitting portion of the bat.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A bat comprising:

a tip end;

a butt end;

a handle portion extending from said butt end;

a hitting portion extending from said tip end; and a connecting portion between said handle portion and said hitting portion; wherein at least part of the length of said bat is formed from a single tube, said single tube having one or more pairs of opposed openings;

further comprising a hollow, tubular plug disposed between each pair of said opposed openings, having opposite ends bonded to said openings to form a port extending from one side of said bat to the opposite side of said bat.

2. The bat as set forth in claim 1, wherein said tube and each of said plugs are made of a composite material.

3. The bat set forth in claim 1, wherein said tube is made of metal and each of said plugs are made of a composite material.

4. The bat set forth in claim 1, wherein each of said plugs are made of metal.

5. The bat set forth in claim 1, wherein said single tube and each of said plugs are made of metal.

6. The bat as set forth in claim 1, wherein said single tube forms at least the handle portion.

7. The bat as set forth in claim 1, wherein said single tube forms at least the connecting portion.

8. The bat as set forth in claim 1, wherein said single tube forms at least the hitting portion.

9. The bat as set forth in claim 1, wherein at least one of said ports is oval in shape, to form a pair of opposed arches, with the long dimension of the oval oriented with the longitudinal axis of said bat.

10. The bat as set forth in claim 1, wherein said hitting portion, said handle portion, and said connecting portion are each formed of a single tube.

11. The bat as set forth in claim 10, wherein said hitting portion, said handle portion, and said connecting portion are formed from the same tube.

12. The bat as set forth in claim 10, wherein at least one of said hitting portion, said handle portion, and said connecting portion are formed of a single tube having at least one end which is bonded to an end of another single tube forming one of the other bat portions.

13. The bat as set forth in claim 10, wherein at least one of said hitting portion, said handle portion, and said connecting portion are formed of a single tube having at least one end which is bonded to an end of another single tube forming one of the other bat portions, and wherein said tubes are of different materials.

14. The bat as set forth in claim 1, wherein at least one of said ports is located near said tip.

15. The bat as set forth in claim 1, wherein at least one of said ports is located in said connecting portion.

16. The bat as set forth in claim 1, wherein at least one of said ports is located near said tip, and at least one of said ports is located in said connecting portion.

17. The bat as set forth in claim 1, wherein one or more of said ports has a longitudinal axis oriented in a first direction and one or more of said ports has longitudinal axes oriented in a second direction orthogonal to said first direction.

18. The bat as set forth in claim 17, wherein said ports having longitudinal axes oriented in said first direction are located at different axial locations than said ports having longitudinal axes oriented in said second direction.

19. The bat as set forth in claim 17, wherein one of said ports having a longitudinal axis oriented in said first direction and one of said ports having a longitudinal axis oriented in said second direction are located at the same axial location.

20. The bat as set forth in claim 1, wherein at least one of said handle portion, said connecting portion and said hitting portion is a metal tube.

21. The bat as set forth in claim 1, wherein said ports vary in size.

22. The bat as set forth in claim 1, wherein the longitudinal axes of said ports are spaced apart from one another by at least two distances.

23. The bat as set forth in claim 1, wherein the longitudinal axes of said ports have different, angular orientations with respect to the longitudinal axis of said bat.

24. The bat as set forth in claim 1, wherein said bat includes an internal core and external shell.

25. The bat as set forth on claim 1 wherein the cross sectional shape of said handle portion is smaller in circumference than the cross sectional shape of said hitting portion and further wherein the cross sectional shape of said connecting portion is tapered between said handle portion and said hitting portion.

26. The bat as set forth in claim 1, wherein at least one of said handle portion, said connecting portion and said hitting portion is composed of a composite material.

27. A bat comprising:

a tube member fabricated of a tube of multiple plies of carbon fibers held together with a thermoset binder, the fibers of each ply being parallel to one another, said tube member having a generally hollow tubular configuration; at least one pair of aligned holes extending through opposing sides of said tube; and a hollow, tubular plug extending through each of said pairs of aligned holes, wherein opposite ends of said plug are bonded to said tube to form a port extending through said bat.

28. The bat as set forth in claim 27, wherein the thermo set binder is a polymer.

29. The bat as set forth in claim 27, wherein the thermo set binder is selected from the group consisting of epoxy, polyester, vinyl, phenolic and polyimide.

* * * * *